US008975457B2

(12) United States Patent
Bressler

(10) Patent No.: US 8,975,457 B2
(45) Date of Patent: Mar. 10, 2015

(54) METHODS FOR PRODUCING FUELS AND SOLVENTS SUBSTANTIALLY FREE OF FATTY ACIDS

(75) Inventor: David Bressler, St. Albert (CA)

(73) Assignee: The Governors of the University of Alberta, Edmonton, Alberta (CA)

( * ) Notice: Subject to any disclaimer, the term of this patent is extended or adjusted under 35 U.S.C. 154(b) by 36 days.

(21) Appl. No.: 13/580,994

(22) PCT Filed: Feb. 24, 2011

(86) PCT No.: PCT/IB2011/000464

§ 371 (c)(1),
(2), (4) Date: Aug. 24, 2012

(87) PCT Pub. No.: WO2011/104626

PCT Pub. Date: Sep. 1, 2011

(65) Prior Publication Data

US 2012/0316370 A1 Dec. 13, 2012

Related U.S. Application Data

(60) Provisional application No. 61/307,568, filed on Feb. 24, 2010.

(51) Int. Cl.

| | |
|---|---|
| ***C10L 1/04*** | (2006.01) |
| ***C10G 3/00*** | (2006.01) |
| ***C10G 21/16*** | (2006.01) |

(52) U.S. Cl.

CPC ... *C10L 1/04* (2013.01); *C10G 3/40* (2013.01); *C10G 3/44* (2013.01); *C10G 21/16* (2013.01);

(Continued)

(58) Field of Classification Search

USPC ..... 585/14, 16, 240, 638, 733; 44/306–308, 44/605; 554/195, 202, 205

See application file for complete search history.

(56) References Cited

U.S. PATENT DOCUMENTS

| | | | |
|---|---|---|---|
| 2,053,845 | A | 9/1936 | Otto et al. |
| 2,437,438 | A | 3/1948 | Petroff et al. |

(Continued)

FOREIGN PATENT DOCUMENTS

| | | |
|---|---|---|
| GB | 175974 | 6/1923 |
| GB | 218278 | 4/1925 |

(Continued)

OTHER PUBLICATIONS

Ayhan Demirbas; "Biodiesel fuels from vegetable oils via catalytic and non-catalytic supercritical alcohol transesterifications and other methods: a survey," Energy Conversion & Management; 2003; 17 pgs; pp. 2093-2109, vol. 44; Elsevier Science Ltd., Turkey.

M.E. Tat, J.H. Van Gerpen; "Biodiesel Blend Detection with a Fuel Composition Sensor," Applied Engineering in Agriculture, 2003; 8 pgs; pp. 125-131; vol. 19(2); American Society of Agricultural Engineers.

(Continued)

*Primary Examiner* — Brian McCaig

(74) *Attorney, Agent, or Firm* — Gardner Groff Greenwald & Villanueva, PC

(57) ABSTRACT

Described herein are methods for producing fuels and solvents from fatty acid resources. In general, the pyrolysis products of fatty acids are extracted in order to remove residual fatty acids and produce very pure hydrocarbon compositions composed of alkanes and alkenes. The fatty acids removed from the extraction step can be further pyrolyzed to produce additional hydrocarbons or, in the alternative, the fatty acids can be isolated and used in other applications. Also disclosed herein are fuels and solvents produced by the methods described herein.

29 Claims, 4 Drawing Sheets

(52) U.S. Cl.
CPC *C10G 2300/1014* (2013.01); *C10G 2300/1018* (2013.01); *C10G 2300/44* (2013.01); *C10G 2400/18* (2013.01); *C10G 2400/20* (2013.01); *C10G 2400/22* (2013.01)
USPC ..... 585/16; 585/14; 585/240; 585/638; 585/733; 44/306; 44/307; 44/308; 44/605

(56) References Cited

U.S. PATENT DOCUMENTS

| | | | | |
|---|---|---|---|---|
| 2,516,112 | A * | 7/1950 | Freiman | 554/158 |
| 2,660,601 | A * | 11/1953 | Dickinson | 554/134 |
| 2,836,601 | A | 5/1958 | Godfrey et al. | |
| 3,872,142 | A * | 3/1975 | Saito et al. | 554/207 |
| 4,235,702 | A | 11/1980 | Smith | |
| 4,554,397 | A | 11/1985 | Stern et al. | |
| 4,992,605 | A | 2/1991 | Craig et al. | |
| 5,225,580 | A | 7/1993 | Zinnen | |
| 5,578,090 | A | 11/1996 | Bradin | |
| 5,705,722 | A | 1/1998 | Monnier et al. | |
| 5,917,068 | A | 6/1999 | Barnicki et al. | |
| 7,491,858 | B2 | 2/2009 | Murzin et al. | |
| 8,067,653 | B2 | 11/2011 | Bressler | |
| 2003/0089027 | A1 | 5/2003 | Jordan | |
| 2003/0089028 | A1 | 5/2003 | Jordan | |
| 2004/0230085 | A1 | 11/2004 | Jakkula et al. | |
| 2007/0068848 | A1 | 3/2007 | Monnier et al. | |
| 2007/0135316 | A1 | 6/2007 | Koivusalmi et al. | |
| 2007/0277429 | A1 | 12/2007 | Jackam et al. | |
| 2008/0034645 | A1* | 2/2008 | Bressler | 44/308 |
| 2008/0305531 | A1 | 12/2008 | Lam et al. | |
| 2009/0069610 | A1* | 3/2009 | Roberts et al. | 585/24 |
| 2009/0182166 | A1* | 7/2009 | Kubatova et al. | 560/129 |
| 2009/0259082 | A1 | 10/2009 | Deluga et al. | |
| 2012/0136185 | A1 | 5/2012 | Bressler | |

FOREIGN PATENT DOCUMENTS

| | | |
|---|---|---|
| WO | 9745197 | 12/1997 |
| WO | 2004035714 | 4/2004 |
| WO | 2007027955 | 3/2007 |
| WO | 2007068798 | 6/2007 |
| WO | 2007027669 | 8/2007 |
| WO | 2008029301 | 3/2008 |
| WO | 2008103204 | 8/2008 |
| WO | 2009047793 | 4/2009 |
| WO | 2011007046 | 1/2011 |

OTHER PUBLICATIONS

Mustafa E. Tat, Jon H. Van Gerpen; "The Kinematic Viscosity of Biodiesel and Its Blends with Diesel Fuel," JAOCS; 1999; 3 pgs; pp. 1511-1513; vol. 76; Iowa State University, Ames, Iowa.
Anjana Srivastava, Ram Prasad; "Triglycerides-based diesel fuels; Renewable & Sustainable Energy Reviews," 2000; 23 pgs; pp. 111-133; vol. 4; Elsevier Science Ltd., India.
A.V. Bridgwater, G.V.C. Peacocke; Fast pyrolysis processes for biomass; "Renewable & Sustainable Energy Reviews," 2000; 73 pgs; pp. 1-73; vol. 4; Elsevier Science Ltd.
Michael S. Graboski, Robert L. McCormick; "Combustion of Fat and Vegetable Oil Derived Fuels in Diesel Engines," Prog. Energy Combust. Sci., 1998; 40 pgs; pp. 125-164; vol. 24; Elsevier Science Ltd., Great Britain.
S. Sensoz, D. Angin, S. Yorgun; "Influence of particle size on the pyrolysis of rapeseed (*Brassica napus* L.): fuel properties of bio-oil," Biomass & Bioenergy; 2000; 9 pgs; pp. 271-279; vol. 19; Elsevier Science Ltd., Turkey.
M. Predel, W. Kaminsky; "Pyrolysis of Rape-Seed in a Fluidised-Bed Reactor," Bioresource Technology 66; 1998; 5 pgs; pp. 113-117; Elsevier Science Ltd., Germany.
F Karaosmanoglu, E. Tetik, E. Gollu; "Biofuel production using slow pyrolysis of the straw and stalk of the rapeseed plant," Fuel Processing Technology, 1999; 12 pgs; pp. 1-12; vol. 59; Elsevier Science B.V., Turkey.
J. Piskorz, P. Majerski, D. Radlein, A. Vladars-Usas, D.S. Scott; "Flash Pyrolysis of cellulose for production of anhydro-oligomers," Journal of Analytical and Applied Pyrolysis, 2000; 22 pgs; pp. 145-166; vol. 56; Elsevier Science B.V., Canada.
Mustafa E. Tat, Jon H. Van Gerpen; "The Specific Gravity of Biodiesel and Its Blends with Diesel Fuel," JAOCS, 2000; 5 pgs; pp. 115-119; vol. 77, No. 2.
K.D. Maher, D.C.Bressler; "Pyrolysis of triglyceride materials for the production of renewable fuels and chemicals," Bioresource Technology, 2007; 18 pgs; pp. 2351-2368; vol. 98.
Katsumori Tanabe,Murray R. Gray; "Role of Fine Solids in the Coking of Vacuum Residues," Energy and Fuels, 1997; 4 pgs; pp. 1040-1043; vol. 11.
David C. Bressler, Murray R. Gray; "Hydrotreating Chemistry of Model Products from Bioprocessing of Carbazoles" Energy and Fuels, 2002; 11 pgs; pp. 1076-1086; vol. 16.
Ayhan Demirbas; "Diesel Fuel from Vegetable Oil via Transesterification and Soap Pyrolysis",Energy Sources, 2002; 8 pgs; pp. 835-841; vol. 24.
Paul H.L. Moquin, Feral Temelli, Helena Sovova, Marleny D.A. Saldana;"Kinetic modeling of glycerolysis-hydrolysis of canola oil in supercritical carbon dioxide media usin equilibrium data," The Journal of Supercritical Fluids, 2006; 8 pgs; pp. 417-424; vol. 37.
A.T. Erclyes, L. Dandik, and F.S. Erkal; "The Decomposition of Secondary Esters of Castor Oil with Fatty Acids",JOACS; Sep. 1991; 4 pgs; pp. 642-645; vol. 68, No. 9.
Snare et al. (Jun. 28, 2006) Heterogeneous Catalytic Deoxygenation of Steric Acid for Production of Biodiesel, Ind. Eng. Chem. Res., 45, 5708-5715.
Jaw, "The Thermal Decomposition Behaviors of Stearic Acid, Paraffin Wax and Polyvinyl Butyral", Thermochima Acta, pp. 165-168, 2001, Elsevier Science B.V., Taiwan.
Alencar, "Pyrolysis of Tropical Vegetable Oils", J. Agric. Food Chem. vol. 31, No. 6, pp. 1268-1270, 1983, American Chemical Society, USA.
Office Action dated Nov. 8, 2010 for Ukrainian Application No. 200901198.
Office Action dated Mar. 14, 2011 for Ukrainian application No. 200901198.
Serguchev et al. "Oxidate Decarboxylation of Carboxylic Acids", Russian Chemical Reviews, 1980, vol. 49, pp. 227-2285, Russia.
Kubickova et al., "Hydrocarbons for diesel fuel via decarboxylation of vegetable oils", Catalysis Today, 2005, vol. 106, pp. 197-200, Elsevier B.V., Finland.
Kirk Othmer, "Carboxylic Acid (Manufacture)," Encyclopedia of Chemical Technology, Dec. 31, 1978.
European Search Report dated Jul. 22, 2011 for European Application No. 07849051.3.
Office Action for Russian Application No. 2009105075104 dated Jun. 30, 2011.
Foglia, et al. "Decarbonylation Dehydration of Fatty Acids to Alkenes in the Presence of Transition Metal Complexes," Journal of the American Oil Chemists Society, vol. 53, Dec. 1976, pp. 737-741.
Maier, et al. "Gas Phase Decarboxylation of Carboxylic Acids," Chem. Ber. 115, pp. 808-812 (1982).
Watanabe, et al. "Decomposition of a Long Chain Saturated Fatty Acid with Some Additives in Hot Compressed Water," Energy Conversion and Management, 47, (2006), pp. 3344-3350.
Zhang, et al. "Catalytic Decarboxylation of Fatty Acids by Iron-containing Minerals in Immature Oil Source Rocks at Low Tempature," Chinese Science Bulletin, vol. 44, No. 16., Aug. 1999, pp. 1523-1527.
Zhe, et al. "Catalytic Decarboxylations of Fatty Acids in Immature Oil Source Rocks," Science in China, vol. 46, No. 12, Dec. 2003, pp. 1250-1260.
Internation Search Report and Written Opinion dated Aug. 27, 2008 for international application No. PCT/IB2007/004187.
Internation Search Report and Written Opinion dated Sep. 4, 2008 for international application No. PCT/IB2007/004187.
International Search Report dated Sep. 6, 2011 for international application No. PCT/IB2011/000464.

* cited by examiner

METHODS FOR PRODUCING FUELS AND SOLVENTS SUBSTANTIALLY FREE OF FATTY ACIDS

CROSS REFERENCE TO RELATED APPLICATION

This application is a U.S. national phase application under 35 USC 371 of international application number PCT/IB 2011/000464, filed Feb. 24, 2011, which claims priority upon U.S. provisional application Ser. No. 61/307,568, filed Feb. 24, 2010. This application is hereby incorporated by reference in its entirety for all of its teachings.

BACKGROUND

There are increasing social and economic pressures to develop renewable energy sources as well as renewable and biodegradable industrial and consumer products and materials. The catalytic conversion of natural feedstocks to value-added products has resulted in new approaches and technologies whose application spans across the traditional economic sectors. There is a new focus on biorefining, which can be described as the processing of agricultural and forestry feedstocks capturing increased value by processing them into multiple products including platform chemicals, fuels, and consumer products. The conversion of tallow and other organic oils to biodiesel has been previously studied in depth. Traditionally, this conversion involves the trans-esterification of the triglyceride to produce three methyl-esterified fatty acids and a free glycerol molecule. The chemical, rheological, and combustion properties of the resulting "biodiesel" have also been extensively investigated. Unfortunately, these methyl-ester based fuels have been shown to be far more susceptible to oxidation and have lower heating values than the traditional petroleum based diesel fuels. As a result the traditional biodiesels must be blended with existing diesel stock and may also have to be supplemented with antioxidants to prolong storage life and avoid deposit formation in tanks, fuel systems, and filters.

The pyrolysis of fatty acids is one approach to producing the corresponding alkanes and alkenes useful as solvents and fuels. However, fatty of various chain lengths are formed as part of the pyrolysis products as well as unreacted feedstock. The presence of the fatty acids are undesirable for the applications listed above if they are to meet industry and regulatory standards. They must therefore be removed in order to be useful as hydrocarbon solvents and fuels.

SUMMARY

Described herein are methods for producing fuels and solvents from fatty acid resources. In general, the pyrolysis products of fatty acids are extracted in order to remove residual fatty acids and produce very pure hydrocarbon compositions composed of alkanes and alkenes. The fatty acids removed from the extraction step can be further pyrolyzed to produce additional hydrocarbons or, in the alternative, the fatty acids can be isolated and used in other applications. Also disclosed herein are fuels and solvents produced by the methods described herein. The advantages of the methods and compositions described herein will be set forth-in part in the description which follows, or may be learned by practice of the aspects described below. The advantages described below will be realized and attained by means of the elements and combinations particularly pointed out in the appended claims. It is to be understood that both the foregoing general description and the following detailed description are exemplary and explanatory only and are not restrictive.

BRIEF DESCRIPTION OF FIGURES

The accompanying Figures, which are incorporated in and constitute a part of this specification, illustrate several aspects described below.

DETAILED DESCRIPTION

Figure 1:
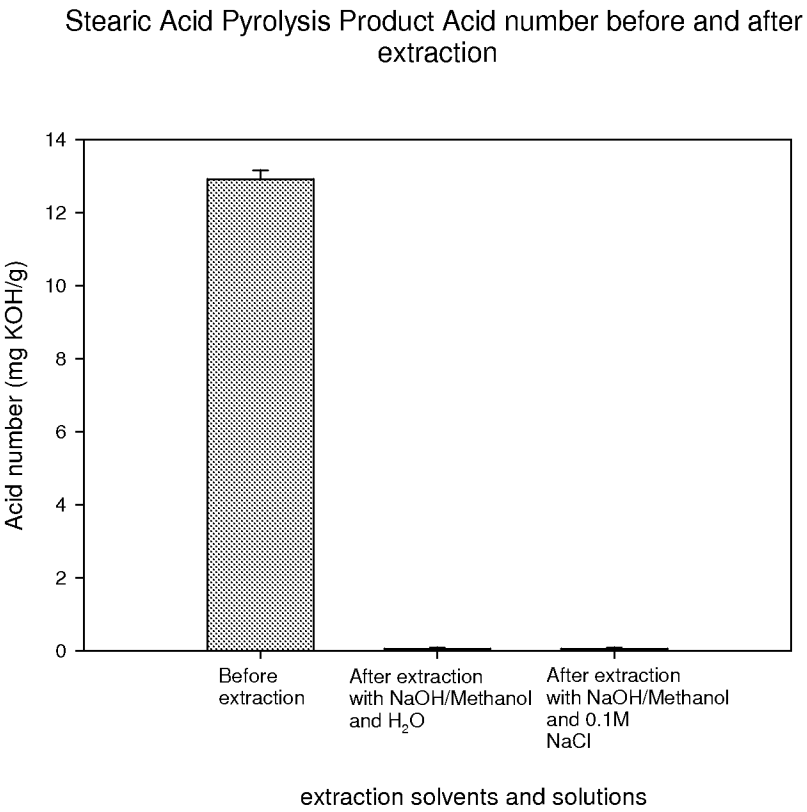
FIG. 1 shows the ASTM D974 acid number of stearic acid pyrolysis product (SAPP) before and after extraction.

Before the present materials, articles, and/or methods are disclosed and described, it is to be understood that the aspects described below are not limited to specific compounds, synthetic methods, or uses as such may, of course, vary. It is also to be understood that the terminology used herein is for the purpose of describing particular aspects only and is not intended to be limiting.

In this specification and in the claims that follow, reference will be made to a number of terms that shall be defined to have the following meanings:

Throughout this specification, unless the context requires otherwise, the word "comprise," or variations such as "comprises" or "comprising," will be understood to imply the inclusion of a stated integer or step or group of integers or steps but not the exclusion of any other integer or step or group of integers or steps.

It must be noted that, as used in the specification and the appended claims, the singular forms "a," "an" and "the" include plural referents unless the context clearly dictates otherwise. Thus, for example, reference to "an oil" includes a single oil or mixtures of two or more oils.

"Optional" or "optionally" means that the subsequently described event or circumstance can or cannot occur, and that the description includes instances where the event or circumstance occurs and instances where it does not.

Described herein are methods for producing fuels and solvents from fatty acid resources. In one aspect, the method comprises:

a. separating one or more fatty acids from the fatty acid resource;
b. converting the fatty acid to one or more alkanes or alkenes to produce a hydrocarbon composition; and
c. extracting the hydrocarbon composition to substantially remove fatty acids present in the hydrocarbon composition with an extraction solvent.

The term "fatty acid resource" as defined herein is any source of free fatty acid or a precursor to a free fatty acid upon subsequent processing. For example, a triglyceride is a precursor to a free fatty acid, where hydrolysis of the glycerol group produces the free fatty acid. Examples of fatty acid resources include, but are not limited to, vegetable oil, animal fats, spent cooking oil, lipids, phospholipids, soapstock, or other sources of triglycerides, diglycerides or monoglycerides. In one aspect, the vegetable oil comprises corn oil, cottonseed oil, canola oil, rapeseed oil, olive oil, palm oil, peanut oil, ground nut oil, safflower oil, sesame oil, soybean oil, sunflower oil, algae oil, almond oil, apricot oil, argan oil, avocado oil, ben oil, cashew oil, castor oil, grape seed oil, hazelnut oil, hemp seed oil, linseed oil, mustard oil neem oil, palm kernel oil, pumpkin seed oil, rice bran oil, walnut oil, a combination thereof. In another aspect, the animal fat comprises blubber, cod liver oil, ghee, lard, tallow, derivatives thereof (e.g., yellow grease, used cooking oil, etc.), or a combination thereof.

It is contemplated that the fatty acid resource can be further purified prior to separation step (a). For example, the fatty acid resource can be distilled or extracted to remove any undesirable impurities. In the alternative, the fatty acid resource can be used as-is and proceed to separation step (a). The source of the fatty acid resource will determine if any pre-purification steps are required.

Separation step (a) involves removing or isolating one or more fatty acids from the fatty acid resource. A number of different techniques are known in the art for the isolation and purification of fatty acids. For example, U.S. Pat. No. 5,917,501 discloses a process for isolating fatty acids. The process involves hydrolyzing a naturally occurring lipid mixture containing phospholipids, triglycerides, and sterols to form a two-phase product containing a fatty acid phase comprised of free fatty acids and sterols, and an aqueous phase comprised of water, glycerol, and glycerol phosphoric acid esters. The aqueous phase is separated from the fatty acid phase and the crude fatty acid phase is heated to convert the free sterols to fatty acid sterol esters. The free fatty acids are distilled from the fatty acid sterol esters to yield purified fatty acids, which are free of cholesterol and other sterols, and phosphorous compounds. In other aspects, the fatty acid resource is exposed to acid in order to hydrolyze a fatty acid precursor present in the fatty acid resource to produce the corresponding fatty acid. For example, vegetable oils are rich in triglycerides, which upon acid hydrolysis, produce the free fatty acid and glycerol.

After the separation step, it is desirable to produce a pure or substantially pure form of the fatty acid. The phrase "substantially pure" as used herein is defined as greater than 90%, greater than 95%, greater than 99%, greater than 99.9%, or 100% by weight fatty acid content. The presence of impurities can adversely affect the final composition of the fuel or solvent. For example, if sulfur, oxygen, or nitrogen compounds are present in the fatty acid prior to step (b), undesirable product characteristics result including high sulfur or nitrogen emissions during combustion or side-reactions may occur during step (b) such as the formation of undesirable aromatic compounds.

The nature of the fatty acid will vary depending upon the fatty acid resource. The fatty acid can be a saturated fatty acid, an unsaturated fatty acid, or a combination thereof. Examples of fatty acids include, but are not limited to, butyric acid, lauric acid, myristic acid, palmitic acid, stearic acid, arachidic acid, alpha-linolenic acid, docosahexaenoic acid, eicosapentaenoic acid, linoleic acid, arachidonic acid, oleic acid, erucic acid, a naturally derived fatty acid from a plant or animal source, or a combination thereof. It is contemplated that the fatty acid can be the free acid or the salt/ester thereof. The fatty acid can also be a mixture of fatty acids.

The second step involves converting the fatty acid(s) to a hydrocarbon composition composed of one or more alkanes, alkenes, or mixtures thereof. In general, during the conversion step, the fatty acids are decarboxylated and cracked to produce $CO_2$ and the alkanes or alkenes. The length of the alkane or alkene chain will vary depending upon the fatty acid and reaction parameters, which will be discussed in detail below. In general, the alkanes and alkenes are from $C_1$ to $C_{20}$ hydrocarbons. For example, decarboxylation of stearic acid, which has the formula $CH_3(CH_2)_{16}COOH$, produces $CH_3(CH_2)_{15}CH_3$, shorter alkanes and alkenes, and $CO_2$.

In one aspect, the conversion of the fatty acid to the alkane and/or alkene comprises heating the fatty acid to convert the majority of the fatty acid to an alkane, an alkene, or a mixture thereof. As will be discussed in greater detail below, it is not necessary to completely convert all of the fatty acids to alkanes and alkenes. The temperature of the heating step can vary amongst different parameters In one aspect, the temperature of the heating step is from 220° C. to 650° C., 300° C. to 650° C., 350° C. to 650° C., 350° C. to 600° C., or 250° C. to 500° C. Other parameters to consider are the duration of the heating step and the pressure at which the heating step is conducted. The pressure can range from ambient to 2,000 psi, and the duration of the heating step can be from seconds up to 12 hours. In one asepct, the heating step is from two seconds up to 8 hours. In another aspect, the heating step is performed under an inert atmosphere such as, for example, nitrogen or argon.

By varying reaction conditions during the conversion of the fatty acid to the alkane/alkene, one of ordinary skill in the art can produce short or long chain alkanes/alkenes for fuels and solvents. For example, prolonged heating at elevated temperatures can produce short chain alkanes/alkenes that can be useful as fuels. Alternatively, long chain alkanes/alkenes can be produced by one of ordinary skill in the art by reducing the heating time and temperature. If short chain alkanes or alkenes are produced, reaction conditions can be controlled such that these products are gasses (e.g., methane, propane, butane, etc.) that can be readily removed from the reactor.

In another aspect, the use of a decarboxylation catalyst can be used to facilitate the conversion of the fatty acid to the alkane or alkene. Depending upon the selection of the decarboxylation catalyst, the catalyst can reduce the heating temperature and time. This is desirable in certain instances, particularly if degradation of the alkane/alkene or side reactions (e.g., aromatization) are to be avoided. Examples of to decarboxylation catalysts include, but are not limited to, activated alumina catalysts.

Steps (a) and/or (b) can be performed in batch, semi-batch, or continuous modes of operation. For example, with respect to step (b), a continuous reactor system with unreacted acid recycle could be employed to enhance the yield of desirable alkane/alkene by limiting the duration and exposure of the alkane/alkene in the high temperature reactor. Carbon dioxide and small hydrocarbon products could be recovered, with the gas phase hydrocarbons used as fuel for the reactor or other applications. When a continuous reactor system is used, process conditions can be optimized to minimize reaction temperatures and times in order to maximize product yields and composition. As the reaction can be adjusted to select for a preferred carbon chain length (long, short or medium), the technology has the capability of enriching for a particular product group. From these groups, individual chemicals could be recovered, purified, and sold as pure platform chemicals.

After step (b), the pyrolysis product (i.e., the hydrocarbon composition) is extracted with an extraction solvent to substantially remove fatty acids present in the hydrocarbon composition. As discussed above, the hydrocarbon composition contains alkanes and/or alkenes as well as residual fatty acids. The term "substantially remove" with respect to the fatty acids is defined as completely removing the fatty acids from the hydrocarbon composition or, in the alternative, removing the fatty acids so that they are not detectable using analytical techniques known in the art. For example, the acid number of the hydrocarbon composition after extraction can be at or near zero as measured by ASTM D974 (see for example FIG. 1).

The hydrocarbon composition can be extracted neat or dissolved in an organic solvent prior to extraction. In the case when the hydrocarbon composition is dissolved in a solvent, the solvent selected should substantially if not completely dissolve the hydrocarbon composition. The selection of the solvent can vary depending upon the types of alkanes, alkenes, and fatty acids present in the hydrocarbon composition. For example, non-polar solvents such toluene, petroleum ether, hexane, heptane, octane, pentane, diethyl ether, or any combination thereof can be used herein.

In one aspect, the extraction solvent comprises an aqueous base. In general, the amount of base used is in molar excess to the amount of fatty acid present in the hydrocarbon composition. Techniques for determining the amount of fatty acid present in the hydrocarbon composition and, thus, the amount of base to use are known in the art. The selection of the base can vary as well. A variety of inorganic and organic bases can be used. In one aspect, the base comprises a hydroxide, a carbonate, a sulfate, a phosphate, an acetate, an amide, or any combination thereof. In another aspect, the base comprises an alkali metal hydroxide, alkaline earth metal hydroxide, or a combination thereof.

In certain aspects, it is desirable to change or modify the conditions in order to enhance phase separation between the different phases. For example, the extraction solvent can further comprise one or more organic co-solvents. The co-solvent selected is generally soluble in water. Examples of co-solvents useful herein include, but are not limited to ethers, ketones, alcohols, or any combination thereof. Acyclic ethers (e.g., dimethyl ether, methyl t-butyl ether) and cyclic ethers (e.g., THF) can be used herein. Ketones useful herein include symmetrical and asymmetrical aryl and alkyl compounds. Alcohols such as, for example, a $C_1$ to $C_5$ branched or straight chain alcohol can be used herein as well (e.g., methanol, ethanol, etc). It is also possible to use mixtures of two or more different co-solvents. The order in which the extraction solvent is introduced to the hydrocarbon composition can vary. For example, a solution of base and co-solvent can be added first to the hydrocarbon composition followed by the addition of water to generate the aqueous base. In this aspect, the extraction solvent is produced in situ. Alternatively, a mixture of water, co-solvent, and base can be produced prior to extraction.

In certain aspects, in order to enhance phase separation, one or more salts can be added to the extraction solvent. The addition of the salt can be used with or without the co-solvent depending on the extraction solvent and the hydrocarbon composition that is being extracted. The amount of salt likewise can vary as needed. In one aspect, the salt comprises an alkali metal halide (e.g., NaCl) or an alkaline earth metal halide. In other aspects, during and/or after extraction step (c), heat can be applied for a sufficient time and temperature in order to increase phase separation. In certain aspects, the heating step is performed less than 100° C. to avoid the water present in the extraction solvent from boiling. However, if a pressurized system is used the extraction can be performed up to 180° C.

Similar to steps (a) and (b), the extraction step (c) can be performed in a batch, semi-batch, or continuous process using techniques known in the art. The methods described herein provide numerous advantages over current techniques for producing bio-fuel. In the absence of the extraction step, it is necessary to pyrolyze the fatty acids for longer periods of time and higher temperatures to ensure most if not all of the fatty acids are converted to alkanes and/or alkenes. This is not the case with the methods described herein. Because the extraction step is highly efficient at removing fatty acids from the hydrocarbon composition, it is not necessary to completely convert the fatty acids to alkanes and/or alkenes during pyrolysis. Thus, lower pyrolysis temperatures and shorter pyrolysis times are required. This is particularly advantageous in larger scale, continuous applications. In addition to efficiently removing fatty acids, the fatty acids that are removed can be recycled into the process described herein to further convert the fatty acids to additional alkanes and/or alkenes. Alternatively, the isolated fatty acids can be used in other applications. For example, the polar aqueous phase from the extraction step (c) can be treated with an acid to re-generate the free fatty acid and subsequently extracted to isolated the free fatty acid (see the Examples). Thus, the methods described herein provide an efficient way to convert fatty acids to useful hydrocarbons with minimal waste of resources and energy.

EXAMPLES

The following examples are put forth so as to provide those of ordinary skill in the art with a complete disclosure and description of how the materials, articles, and methods described and claimed herein are made and evaluated, and are intended to be purely exemplary and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is in ° C. or is at ambient temperature, and pressure is at or near atmospheric. There are numerous variations and combinations of reaction conditions, e.g., component concentrations, desired solvents, solvent mixtures, temperatures, pressures and other reaction ranges and conditions that can be used to optimize the product purity and yield obtained from the described process. Only reasonable and routine experimentation will be required to optimize such process conditions.

Example 1

A 0.1M NaOH solution was prepared by dissolving solid NaOH (reagent grade, 97% EMD chemicals Darmstadt) in methanol (HPLC grade, Fisher scientific, New Jersey). A 0.1M NaCl solution was prepared by dissolving crystallized NaCl (food grade 99.6%, Millinckrodt, USP) in distilled water. Stearic acid pyrolysis product was dissolved in toluene (HPLC grade, fisher scientific, New Jersey) to be used in the extraction. The pyrolysis product of stearic acid was produced by heating 1 gram of stearic acid at 410° C. for 1 hour in a batch reactor. The stearic acid pyrolysis product (5 mL) was dissolved in toluene and pipetted into two 50 mL plastic centrifuge tube. To each tube, 20 mL of the 0.1M NaOH in methanol was added. The contents of the tubes were then shaken to mix them thoroughly. Next, 15 mL of distilled water was added to one tube and 15 mL 0.1M NaCl solution was added to the other. The contents of the tubes were shaken then allowed to stand for about 4 hour for the phases to separate. To ensure proper phase separation, the tubes were centrifuged at 3,000 rpm for 10 minutes. The toluene layer of each tube was then pipetted into glass vials and capped for further experiments whereas the polar/aqueous layer was left in the centrifuged tubes.

The polar layer from each tube was acidified using HCl and then back extracted with toluene using a separating funnel. The toluene layer was stored in a glass vial for later analysis. Similar extractions were carried out using oleic acid and linoleic acid pyrolysis products.

Figure 2A:
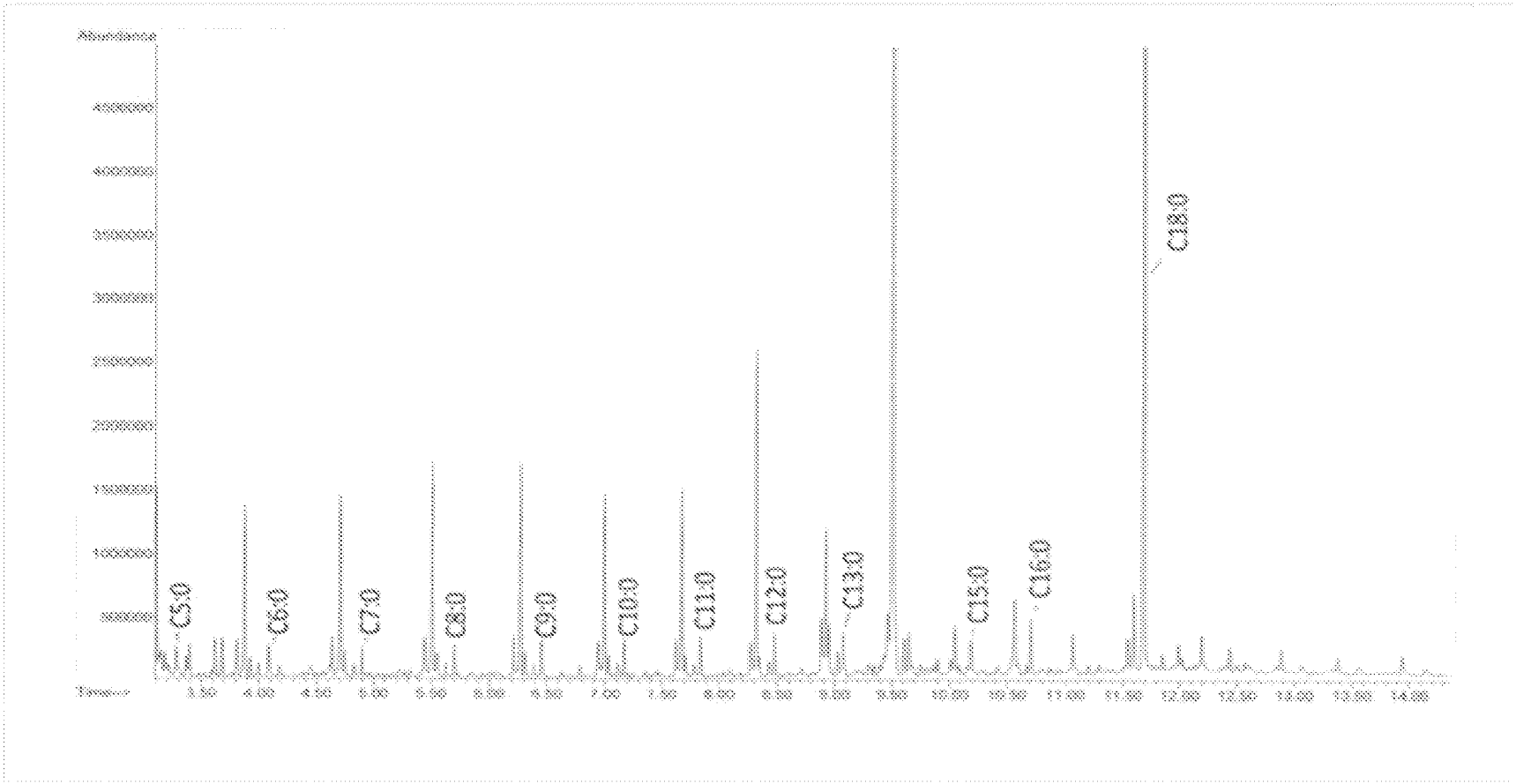
FIG. 2 shows the GC-MS chromatogram of SAPP before (2A) and after (2B) extraction with 0.1M NaOH in methanol and adding water.
Figure 2B:
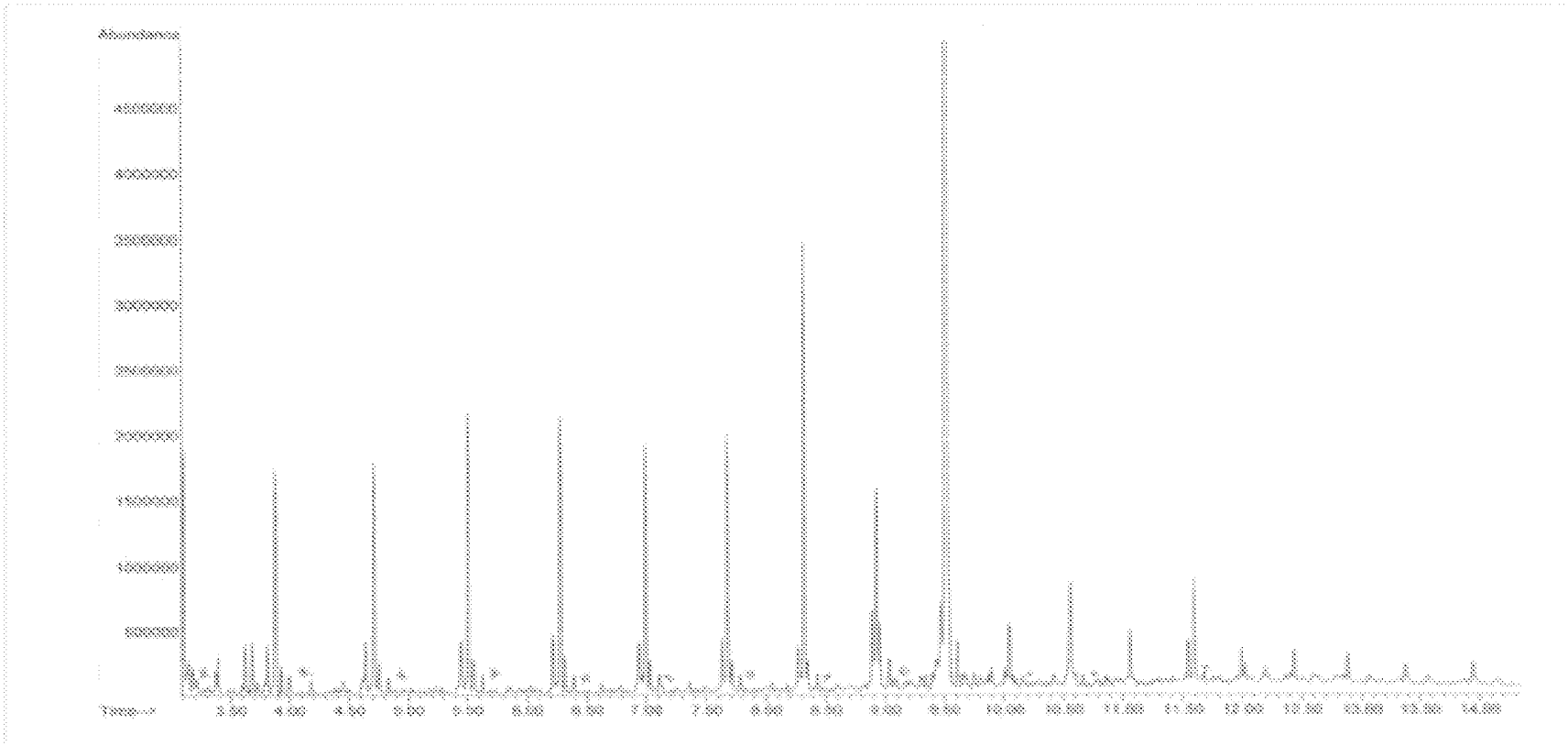

The extent of extraction was determined using ASTM D974 acid number determination and gas chromatography coupled to mass spectrometer. The results of the acid number (FIG. 1) shows that using NaOH in methanol and adding either water or aqueous NaCl resulted in the complete extraction of the fatty acids from stearic acid pyrolysis products. To confirm the results, GC-MS was used and the results (FIG. 2) show the same outcome (i.e., the complete extraction of the fatty acids).

Figure 3:
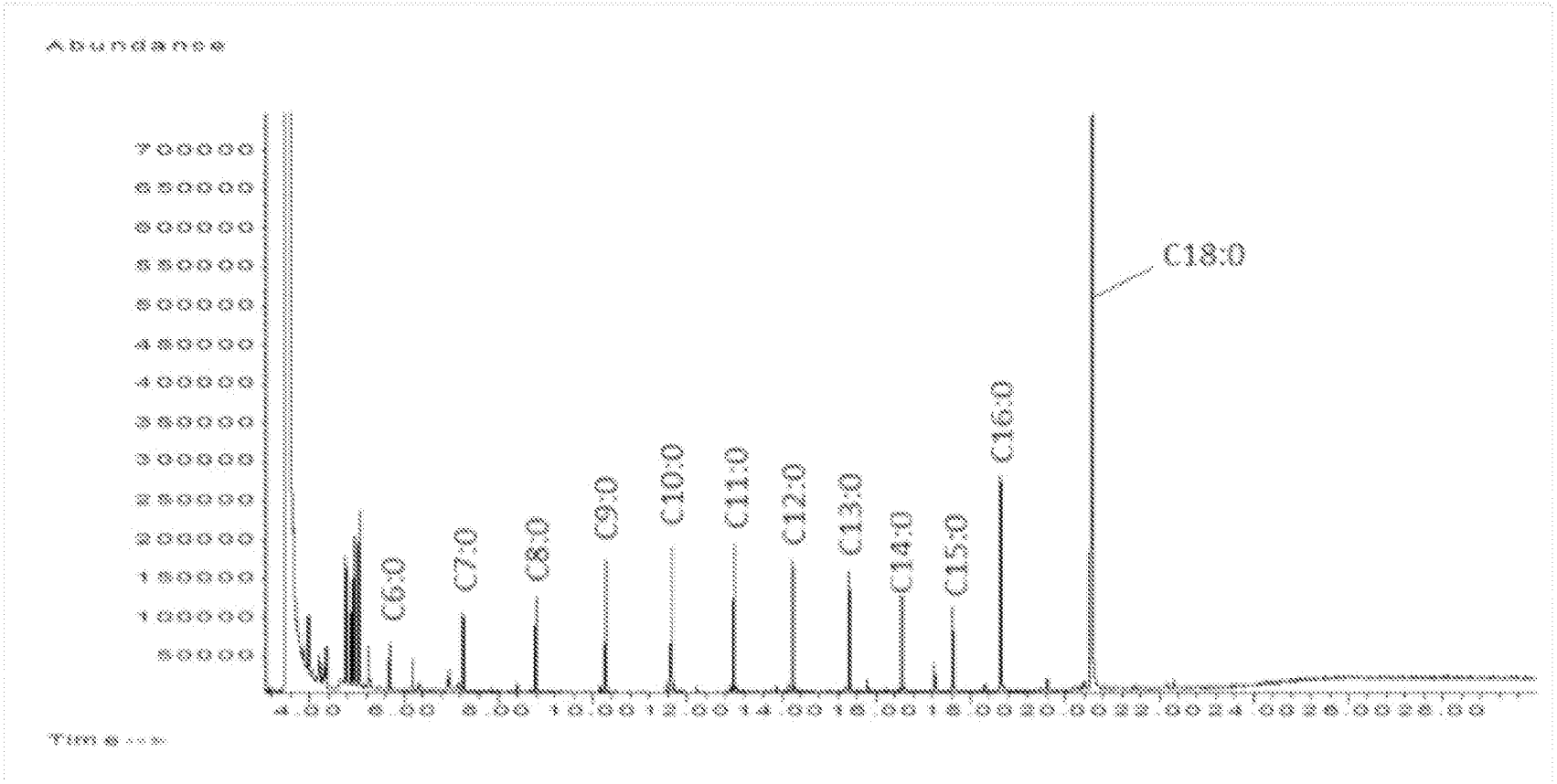
FIG. 3 shows the GC-MS chromatogram of back extracted aqueous fraction of SAPP.

To further confirm that the fatty acids were extracted, the back extracted toluene layer was run on the GC-MS and the results are presented in FIG. 3. The results of the back extraction further confirm that the fatty acids were indeed extracted. Similar results were obtained for the oleic acid and linoleic acid pyrolysis products.

Throughout this application, various publications are referenced. The disclosures of these publications in their entireties are hereby incorporated by reference into this application in order to more fully describe the compounds, compositions and methods described herein.

Various modifications and variations can be made to the materials, methods, and articles described herein. Other aspects of the materials, methods, and articles described herein will be apparent from consideration of the specification and practice of the materials, methods, and articles disclosed herein. It is intended that the specification and examples be considered as exemplary.

What is claimed:

1. A method for producing a mixture of fatty acids from a fatty acid resource, comprising:

a. separating one or more first fatty acids from the fatty acid resource;

b. converting the fatty acid to one or more alkanes or alkenes and mixture of second fatty acids having a chain length less than the chain length than the first fatty acid to produce a first composition; and c. extracting the first composition to substantially remove the second fatty acids present in the first composition with an aqueous extraction solvent to produce a second composition comprising a mixture of second fatty acids.

2. The method of claim 1, wherein the aqueous extraction solvent comprises an aqueous base.

3. The method of claim 2, wherein the base comprises a hydroxide, a carbonate, a sulfate, a phosphate, an acetate, an amide, or any combination thereof.

4. The method of claim 2, wherein the base comprises an alkali metal hydroxide, an alkaline earth metal hydroxide, or a combination thereof.

5. The method of claim 1, wherein the aqueous extraction solvent further comprises an alcohol.

6. The method of claim 5, wherein the alcohol is a $C_1$ to $C_5$ branched or straight chain alcohol.

7. The method of claim 5, wherein the alcohol is methanol.

8. The method of claim 1, wherein the aqueous extraction solvent further comprises a salt.

9. The method of claim 8, wherein the salt comprises an alkali metal halide or an alkaline earth metal halide.

10. The method of claim 8, wherein the salt is NaCI.

11. The method of claim 1, wherein during and/or after extraction step (c) heating the first composition for a sufficient time and temperature to increase phase separation.

12. The method of claim 1, wherein the first composition is dissolved in an organic solvent prior to extraction step (c).

13. The method of claim 1, wherein the fatty acid resource comprises vegetable oil, animal fats, spent cooking oil, lipids, phospholipids, or triglycerides.

14. The method of claim 13, wherein the vegetable oil comprises corn oil, cottonseed oil, canola oil, rapeseed oil, olive oil, palm oil, peanut oil, ground nut oil, safflower oil, sesame oil, soybean oil, sunflower oil, algae oil, almond oil, apricot oil, argan oil, avocado oil, ben oil, cashew oil, castor oil, grape seed oil, hazelnut oil, hemp seed oil, linseed oil, mustard oil neem oil, palm kernel oil, pumpkin seed oil, rice bran oil, or walnut oil, a combination thereof.

15. The method of claim 13, wherein the animal fat comprises blubber, cod liver oil, ghee, lard, tallow, a derivative thereof, or a combination thereof.

16. The method of claim 1, wherein the step (a) comprises (i) separating one or more triglycerides from the vegetable oil or animal fat, and (ii) hydrolyzing the triglyceride to produce the first free fatty acid, and (iii) isolating the first free fatty acid.

17. The method of claim 1, wherein the first fatty acid comprises a saturated fatty acid, an unsaturated fatty acid, or a combination thereof.

18. The method of claim 1, wherein the first fatty acid comprises butyric acid, lauric acid, myristic acid, palmitic acid, stearic acid, arachidic acid, alpha-linolenic acid, docosahexaenoic acid, eicosapentaenoic acid, linoleic acid, arachidonic acid, oleic acid, erucic acid, a naturally derived fatty acid from a plant or animal source, or a combination thereof.

19. The method of claim 1, wherein prior to step (a), the fatty acid resource is further purified by extraction or distillation.

20. The method of claim 1, wherein the step (b) is conducted at a temperature from 220° C. to 650° C., at a pressure from ambient to 2,000 psi, for a duration of two seconds up to 12 hours.

21. The method of claim 1, wherein the step (b) is conducted at a temperature from 250° C. to 500° C. for two seconds up to 8 hours.

22. The method of claim 1, wherein the step (b) is conducted in the presence of a decarboxylation catalyst.

23. The method of claim 22, wherein the decarboxylation catalyst comprises activated alumina.

24. The method of claim 1, wherein the step (b) is conducted under an inert atmosphere.

25. The method of claim 24, wherein the inert atmosphere comprises nitrogen.

26. The method of claim 1, wherein the steps (a), (b) and/or (c) are continuous.

27. The method of claim 1, wherein the second fatty acids have a chain length of less than or equal to 14 carbon atoms.

28. The method of claim 1, wherein the second fatty acids have a chain length of less than or equal to eight carbon atoms.

29. The method of claim 1, wherein the composition comprising the mixture of second fatty acids comprises an incremental linear series of second fatty acids.

* * * * *